United States Patent [19]

Jarvimaki et al.

[11] Patent Number: 4,988,481

[45] Date of Patent: Jan. 29, 1991

[54] ELECTRICAL PIPETTE

[75] Inventors: Kari Jarvimaki, Espoo; Mauno Heinonen, Vantaa; Juha Koivisto, Helsinki, all of Finland

[73] Assignee: Labsystems OY, Helsinki, Finland

[21] Appl. No.: 304,065

[22] Filed: Jan. 30, 1989

[51] Int. Cl.[5] ..... B01L 3/02

[52] U.S. Cl. ..... 422/100; 422/99; 73/864.13; 73/864.14; 73/864.16; 73/864.18

[58] Field of Search ..... 422/100, 49; 73/864.13, 73/864.14, 864.16, 864.18

[56] References Cited

U.S. PATENT DOCUMENTS

| | | | |
|---|---|---|---|
| 3,302,462 | 2/1967 | Pursell | 73/864.18 X |
| 4,120,205 | 10/1978 | Ripphahn et al. | 73/864.13 |
| 4,418,580 | 12/1983 | Satchell et al. | 73/864.13 |
| 4,501,163 | 2/1985 | MacDermott et al. | 73/864.13 |

FOREIGN PATENT DOCUMENTS 8700085 1/1987 World Int. Prop. O. .

*Primary Examiner*—Robert J. Warden
*Assistant Examiner*—Amalia L. Santiago
*Attorney, Agent, or Firm*—Hopgood, Calimafde, Kalil, Blaustein & Judlowe

[57] ABSTRACT

The invention relates to a pipette in which a piston is reciprocated in a cylinder by means of an electric motor. The pipette is preferably provided with a volume adjustment nut comprising locking mechanism to prevent accidental volume adjustment. According to another preferable embodiment the pipette is provided with contact switches for automatically stopping the motor. According to a third preferable embodiment the pipette comprises a cylinder assembly comprising a mechanism for ejecting a tip reservoir of the cylinder.

15 Claims, 4 Drawing Sheets

ELECTRICAL PIPETTE

TECHNICAL FIELD

The present invention relates to an electrical pipette comprising a body, a cylinder in the body, a piston displaceable by the force of an electric motor so as to suck liquid in and to effect removal of the liquid out.

BACKGROUND OF THE INVENTION

In WO No. 87/00085 (Labsystems Oy) some electrically operated pipettes are described. The pipette of FIG. 1 comprises an electric motor by means of which a piston is moved back and forth in a cylinder for sucking liquid into the tip of the cylinder and dispensing it out of the tip. The pipette further comprises an adjustable upper limiter for a rack movement. The adjustable limiter is attached to a screw parallel to the direction of the movement, on which a nut knob is fitted as revolving in a hole in the body of the pipette. Thus, by turning the knob, it is possible to move the limiter in the direction of the rack movement. In this structure there is the drawback that the knob can be turned by accident.

The cited pipette further comprises at the extreme positions of the rack movement limit switches by means of which the motor is stopped. The switch may be a mechanical microswitch or, e.g., a reed tube or a Hall element. In practice, however, the operation of these switches has turned out to be inaccurate.

The cited pipette also comprises a displaceable cylinder part comprising the piston and its cylinder. When separate cylinder tips are used, they have to be removed from the cylinder e.g. by pulling with hands. It would, however, be preferable to remove the tip without touching it with hands.

GENERAL DESCRIPTION OF THE INVENTION

The present invention relates to an electrically operated pipette comprising a body, a cylinder assembly, a toothed rack for moving a piston in the cylinder, two limiters of the movement of the rack, and an electric motor drivingly associated with the rack.

According to one aspect of the invention, the upper limiter is adjustable by means of a nut at the upper end of the body. The nut is provided with locking means for preventing the nut from being turned accidentally.

According to a second aspect of the invention, the pipette is provided with stopping means for automatically stopping the motor when the rack comes to either of its extreme positions. The stopping means comprise conductive limiters and a conductive ram in the rack.

According to a third aspect of the invention, the pipette is provided with a cylinder assembly comprising a cylinder tip ejector means.

DETAILED DESCRIPTION OF A PREFERABLE EMBODIMENT OF THE INVENTION

Figure 1:
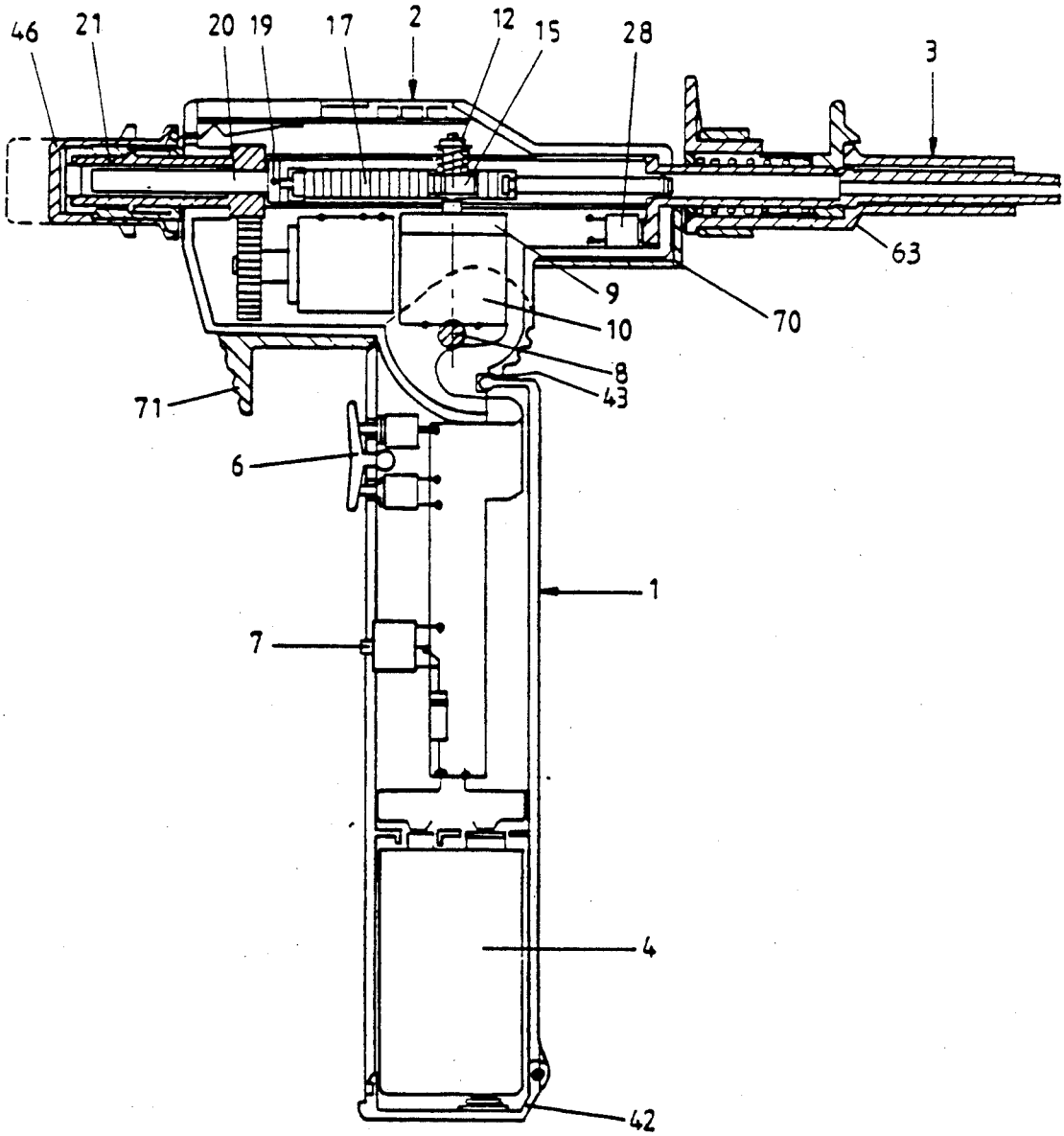
FIG. 1 is a sectional side view of an electrical pipette in accordance with the invention.

The main parts of the pipette of FIG. 1 are the handle 1, the body member 2, and the cylinder assembly 3, the body member having upper and lower portions.

The voltage source 4 consists of an accumulator or a battery, which can be inserted straight into a housing provided at the end of the handle. The housing is provided with a hinged lid 42.

The handle is provided with an operating switch 6 and with a speed adjustment switch 7 cooperably associated with said body member 2.

The handle is attached to the body member by means of a vertically pivotable articulated joint 8. The handle can be releasably locked in the desired position by means of friction locking means 43.

Inside the body, there is a DC motor 10 provided with a gearbox 9. By means of the operating switch 6 voltage can be passed to the motor 10 in either of the two directions, thereby rotating the motor in the desired direction. A gliding clutch 12 is attached to the output shaft 11 of the gearbox. The clutch 12 comprises a clutch flange 13 attached to the output shaft 11, an end flange 14 at the end of the shaft, as well as a cogwheel 15 and a spiral spring 16 with a plate fitted freely on the shaft between the flanges 13 and 14. The spring 16 presses the cogwheel against the clutch flange.

The cogwheel 15 is fitted so that it displaces a toothed rack 17 longitudinally in the body. At the bottom end, the movement of the rack 17 is limited by a stationary limiter 18 (FIG. 3) and at the upper end by an adjustable limiter 19. The adjustable limiter 19 is connected with a screw or threaded shaft 20, on which a threaded nut knob 21 and fitted as revolving in a hole in the body member.

Figure 2:
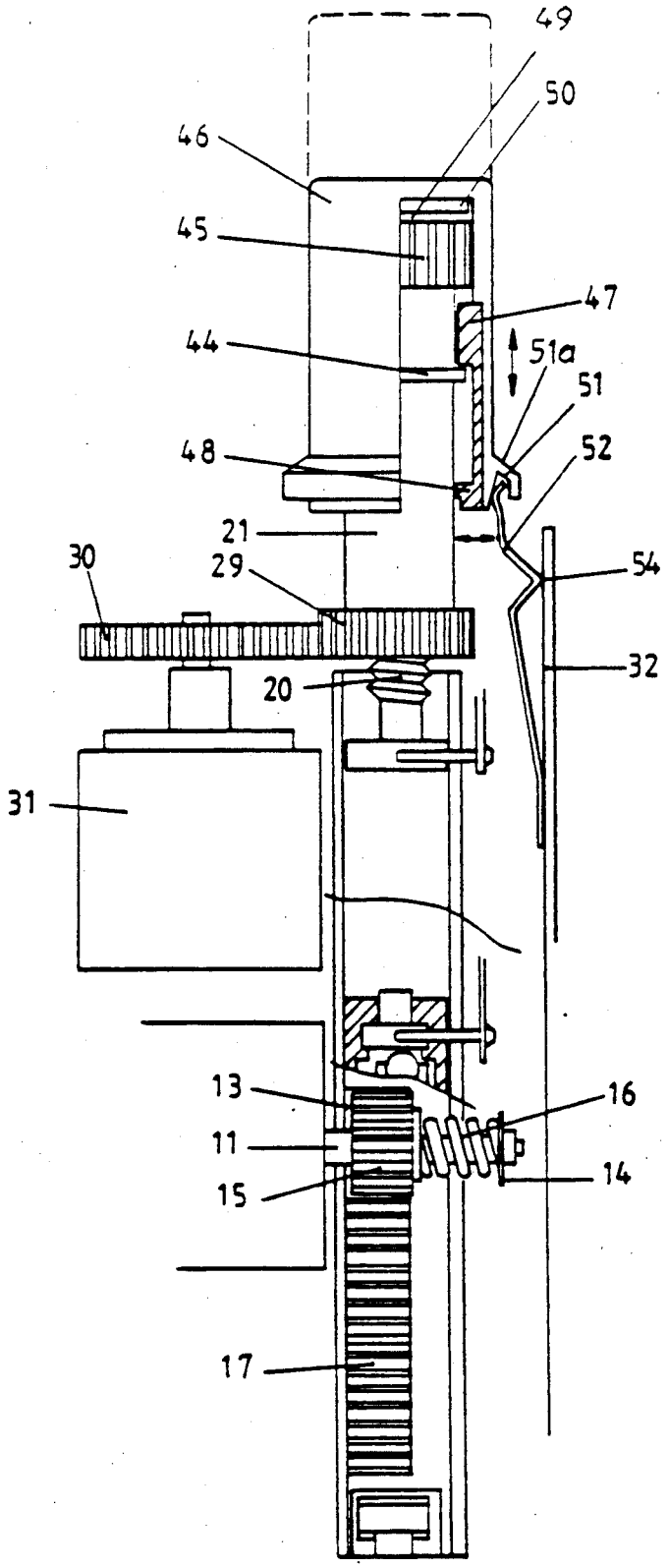
FIG. 2 is a partly sectional side view of the parts in the body member of the pipette.

About the middle of the knob 21 there is a flange 44 and at the upper end a groove ring provided with longitudinal grooves 45 (FIG. 2).

The knob 21 is covered by a cylindrical button 46. On the inner surface of the button 46 there are longitudinal protrusions 47 (FIG. 2) which correspond to the grooves 45 of the knob. When the button 46 is in its lower position the protrusions 47 are on the area between the grooves 45 and the flange 44 and the button can be turned freely without turning the knob 21. When the button 46 is pulled out, the protrusions set into the grooves 45 and turning of the button 46 simultaneously turns the knob 21. Thus volume can be adjusted only when the button 46 is in its retracted upper position, and accidental volume adjustment is prevented.

To prevent dropping of the buttons 46, the inner skirt of the button is provided with a stopping ring 48 which cooperates with the flange 44.

To keep the button 46 normally in its lower position the upper end of the knob 21 is provided with a magnet 49 and the deck of the button with cooperating ferrous plate 50.

The adjusting knob 21 is provided with a cogwheel 29, which rotates the shaft of the volume detector 31 by means of a transmission cogwheel 30. The volume detector 31 may be, e.g., a pulse detector or a potentiometer. The detector 31 is connected to an electronics card 32, wherein the signal is converted in a known way to numerical form in a liquid crystal display while taking the volume range set by the volume selector switches 28 (FIG. 1) into account.

The electronics card also contains other necessary couplings for the operation of the pipette.

The card 32 may also be connected with other adjustment or selection members, such as, for example, calibration trimmers 39, by means of which it is possible to calibrate the initial setting of a volume display.

Figure 5:
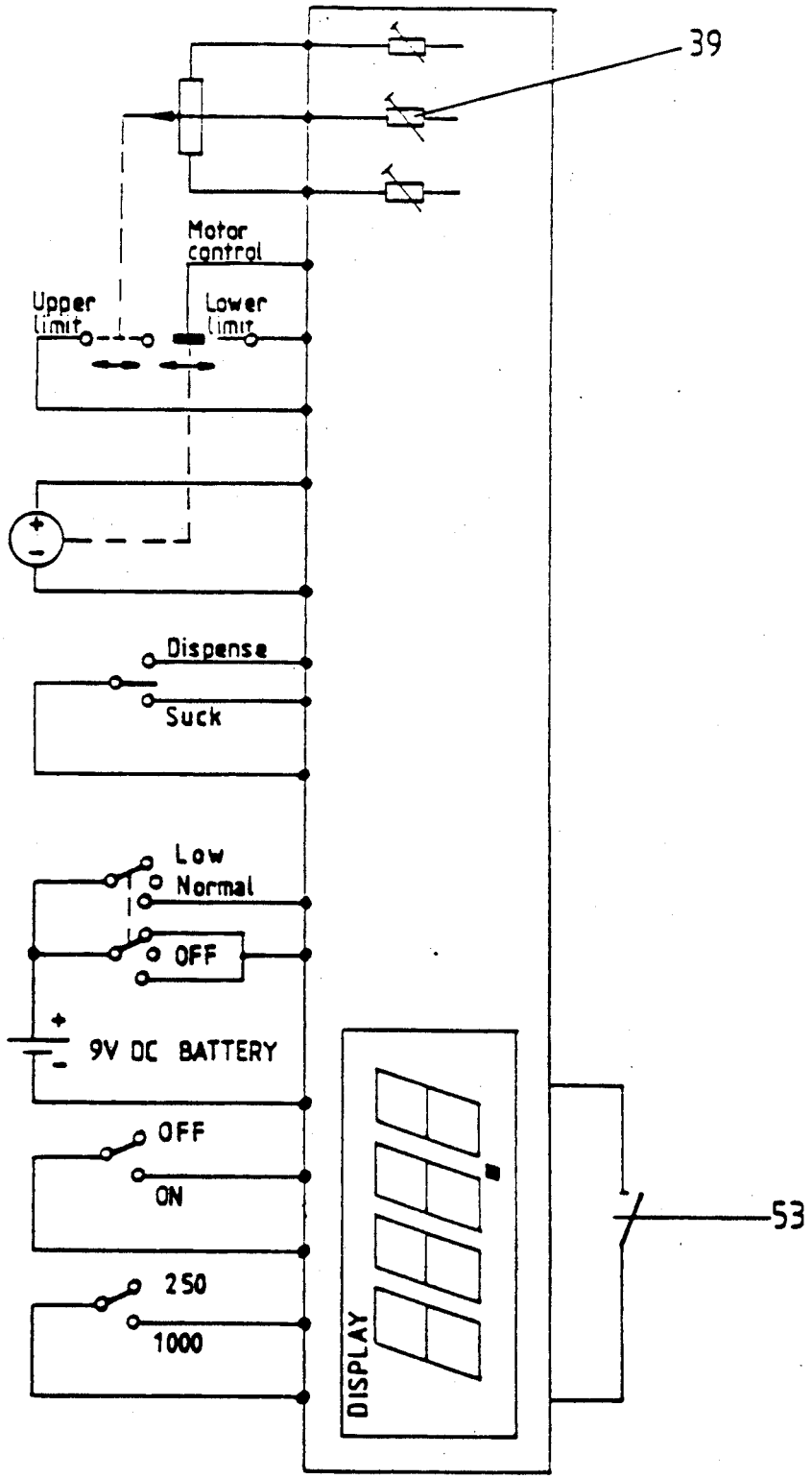
FIG. 5 shows the circuit diagram of the pipette.

FIG. 5 shows a simplified scheme of the electric couplings of the pipette.

The skirt 51*a* of the button 46 is further provided with an annular groove 51. One end of a conductive spring 52 is attached to the volume display circuit in electronic card 32 and the other, the free end is arranged to fit into the annular groove 51. The spring 52 forms a hold switch 53 (FIG. 5). The spring 52 is provided with an outward bended knee 54. The free end of the spring 52 and the annular groove 51 are so designed and arranged that when the free end of the spring 52 is in the annular groove 51, the knee 54 of the spring is in contact, too, and the spring closes volume display circuit so that the volume display is held unchanged. When the button 46 is pulled out, the spring 52 is swung inwards, the knee 54 is released from contact and the volume display can be changed.

Figure 3:
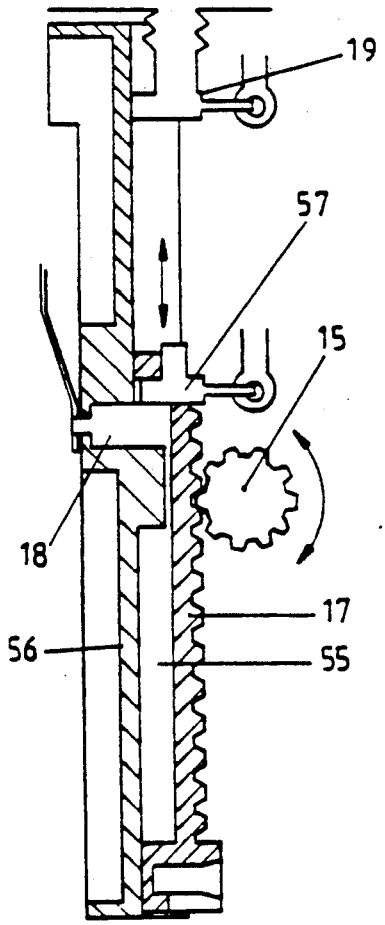
FIG. 3 is a partly sectional view from above showing moving parts in the body member of the pipette.

The toothed rack 17 is provided with a longitudinal bottom groove 55 (FIG. 3). The rack 17 is arranged to be gliding along a track 56. The stationary limiter 18 is placed on the top of the track 56 to correspond to a ram 57 in the upper end of the rack 17. The limiters 18 and 19, and the ram 57 are conductive and connected to the electronic card 32. When the ram 57 meets one of the limiters 18 and 19 the movement of the rack 17 is stopped accurately. Simultaneously the motor 10 is arranged to be turned off.

Figure 4:
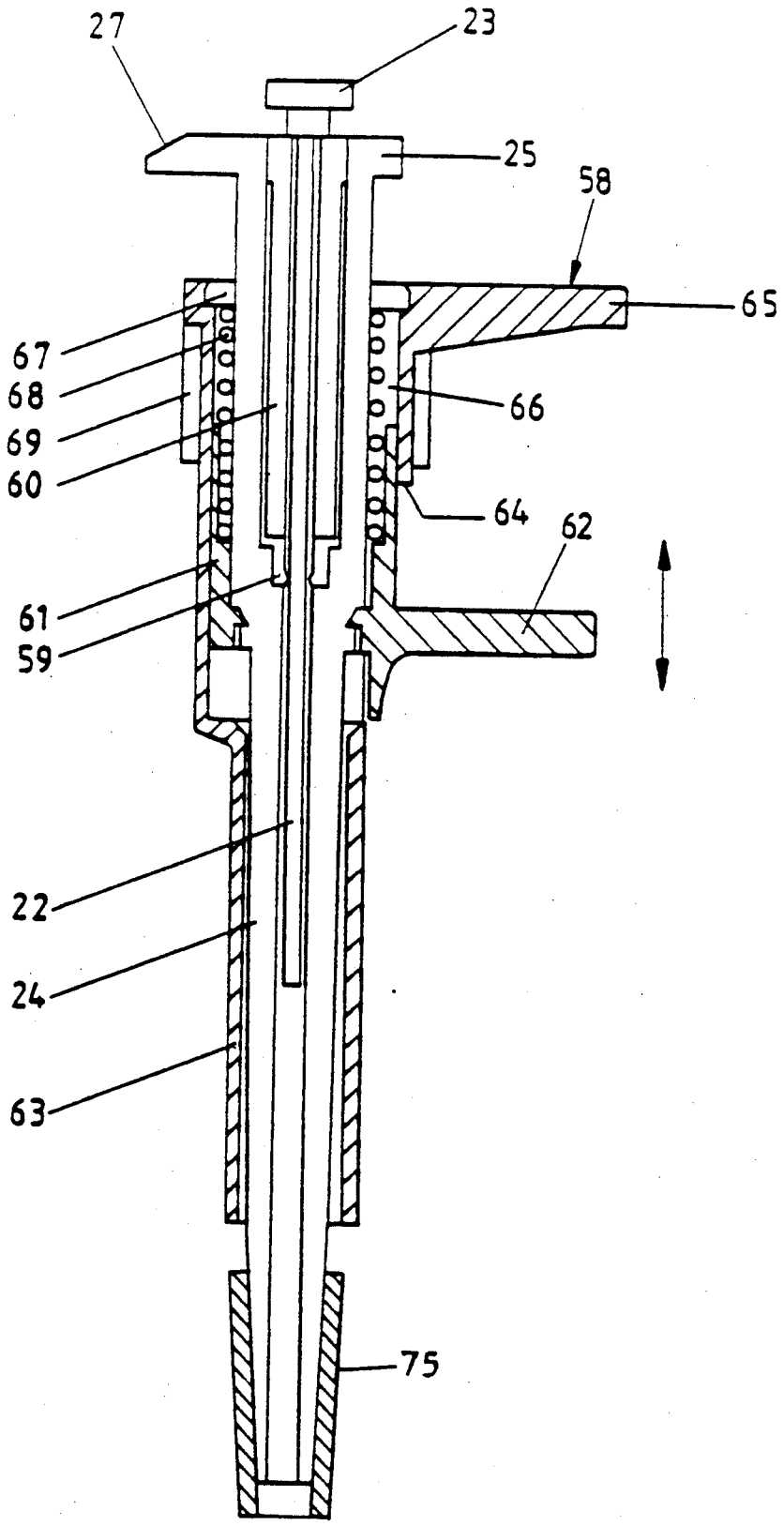
FIG. 4 is a sectional side view of the cylinder assembly of the pipette.

The cylinder assembly (FIG. 4) comprises the piston 22, a cylinder 24 for the piston, a reservoir tip 75, and tip ejection means 58.

The piston 22 is attached to the bottom end of the toothed rack 17 by means of a flange 23. Correspondingly, the cylinder 24 of the piston is attached to the body by means of a flange 25. The piston 22 and the cylinder 24 are attached to the pipette by pushing from the side (in FIG. 1 from above). In this way, it is easy to replace the cylinder part and to provide the pipette with a cylinder part operating within a desired volume range.

The fastening flange 25 of the cylinder is provided with a coded surface means 27, e.g., elevations or, at corresponding locations, with plane portions or other configurations which, when the cylinder is being inserted into its position, press or do not press selector switches 28 (FIG. 1) for volume range, which rest against the elevations. The elevations form a code by means of which the volume display becomes automatically placed within the correct range for each cylinder.

The cylinder 24 has a lower part, the diameter of which corresponds to that of the piston 22, and a upper part which is larger by diameter. The tip of the piston 22 is during operation arranged to be moved in the lower part of the cylinder 24 only.

Between the lower and upper part of the cylinder there is a staggered section, and a sealing ring 59 fitted in this section. The sealing ring is kept in its place by a collar 60.

A fixed sleeve 61 with a protruding handle part 62 is joined around the upper part of the cylinder 24. The cylinder 24 is further surrounded by an ejector sleeve 63 comprising a thinner part to fit around the lower part of the cylinder, and a larger part to fit around the upper part and the fixed sleeve 61 of the cylinder. The ejector sleeve 63 is provided with an opening 64 through which the handle 62 protrudes and in which it can move up and down. The sleeve 63 has a push handle 65 above the handle 62 of the cylinder. The upper part of the fixed sleeve 61 and the ejector sleeve 63 form an annular space 66 around the upper part of the cylinder 24. The space is closed in its upper part by a ring 67 joined to the sleeve 63. In the space 63 there is a pressed spiral spring 68 around the cylinder 24. Thus the spring 68 urges the sleeve 63 toward its upper position. When the handle 65 is pushed downwards, the lower edge of the sleeve 63 ejects the cylinder tip from the cylinder 24. In the cylinder assembly there is also a colored codering 69 which shows the actual volume range.

Around the body member of the pipette there is a slidable sleeve 70 (FIG. 1) with a protruding button 71 on the handle side of the body member. The lower edge of the sleeve 70 is arranged to rest on the ejector sleeve 63. Thus the reservoir tip 75 can be removed also by pushing the button 71.

Although the present invention has been described in conjuction with a preferred embodiment, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. An electrical pipette, comprising a body member having lower and upper portions, a cylinder assembly and a piston disposed within said cylinder assembly extending downwardly from said body member, said cylinder assembly being coupled to said lower portion of said body member, a toothed rack movably mounted within said body member and capable of reciprocal longitudinal movement therein, one end of said rack being provided with means operatively coupling said end to said piston, a first and second limiter disposed within said body member to limit the reciprocal movement of said rack to two limiting positions, said second limiter being disposed at said lower portion of said body member, and said first limiter being disposed in said upper portion of said body member, said first limiter being adjustably positioned in said upper portion of said body member for respectively limiting the reciprocal movement of said rack in a first and second direction corresponding respectively to intake and discharge of fluid into and from said cylinder assembly, an electric motor located within said body member having an output shaft with a pinion cooperably and drivingly associated with said rack, stopping means for stopping said motor when said rack comes to one of the two limiting position of the reciprocal movement, said stopping means comprising a conductive piece in each of said limiters, a conductive ram in said rack which contacts one of said conductive pieces when the rack comes to one of the limiters in its reciprocal movement, an electrical circuit comprising said conductive pieces and said ram for stopping said motor when contact takes place at a limiter, an externally operable bidirectional switch cooperably associated with said body member for operating said motor, a threaded limiter-actuating shaft joined to said first limiter and being longitudinally movable to position or index said first limiter said button having a skirt at the lower end thereof, said threaded limiter-actuating shaft being oriented with its longitudinal axis parallel to the axis of said rack and passing through a means defining an opening in the body member in threading engagement with a threaded nut knob mounted on the limiter-actuating shaft at the upper portion of the body member for rotation in the means defining the opening in the body member, said nut knob being externally manipulable for threadedly adjusting the longitudinal position of the first limiter, said nut knob being provided with nut locking means for releasably locking said nut knob to prevent accidental adjustment, said nut locking means comprising a cylindrical covering button surrounding the nut knob, said covering button having a skirt at the lower end thereof, said covering button having a first and second position, in which said first position the covering button is freely rotatable around the nut knob and in said second position the covering button is joined to the nut knob so that rotating the covering button will also rotate the nub knob, signal transmitting means cooperably associated with said body member operatively coupled to said nut for providing a signal indicative of the position of said threaded shaft, and an externally readable volume indicating means mounted on an external surface of said body member coupled responsively to said transmitting means for indicating the volume intake setting of said pipette as determined by adjustment of said nut knob.

2. A pipette as claimed in claim 1, wherein said covering button is slidable on said nut knob in the direction of said threaded shaft from said first position to said second position.

3. A pipette as claimed in claim 2, wherein said nut locking means further comprise a combination of protrusions on the inner side of the button and corresponding longitudinal grooves of the nut knob which engage in said second position.

4. A pipette as claimed in claim 1, wherein said nut knob and said covering button comprise a magnet and its counter piece the magnetic force of which holds said button in said first position.

5. A pipette as in claim 1, wherein said volume indicating means comprises a liquid crystal display cooperably associated with an electronics card which receives signals from said signal transmitting means, and comprises volume display locking means cooperably associated with said nut knob locking means for preventing change of the displayed volume when said nut knob is locked.

6. A pipette as claimed in claim 5, locking means comprise a covering button surrounding said nut knob, said button having a first and second position, in said first position said button is freely rotating around said nut knob and in said second position said nut is joined to said button so that rotating said button rotates the nut knob and wherein said volume display locking means comprise a hold switch cooperating with said covering button.

7. A pipette as claimed in claim 6, wherein said covering button is slidable on said nut knob said threaded shaft from said first position to said second position, and wherein said hold switch comprises a conductive spring having a free upper end actuated by said button, said spring being coupled to said electronics card.

8. A pipette as claimed in claim 7, wherein said spring is deflected by an annular groove formed on the skirt of said button.

9. A pipette as claimed in claim 7, wherein said spring is in the form of a bended knee.

10. A pipette as claimed in claim 1, wherein said cylinder assembly comprises a cylinder with a lower end for receiving a reservoir tip, ejector means for removing said tip from said lower end of said cylinder, and means for coupling said cylinder assembly to said lower portion of said body member.

11. A pipette as claimed in claim 10, wherein said ejector means comprise a sleeve member slidable longitudinally along said cylinder between an upper and lower position, said sleeve member pushing in said lower position said reservoir tip from said lower end of said cylinder.

12. A pipette as claimed in claim 11, wherein said ejector means further comprise a spring member to urge said sleeve member towards its upper position.

13. A pipette as claimed in claim 10, further comprising a body sleeve member surrounding said body member and slidable along said body member, said body sleeve member comprising a lower push end for pushing the ejector sleeve member to a lower position.

14. A pipette as claimed in claim 1, said cylinder assembly further comprising a cylinder with a lower end for receiving a reservoir tip for liquid, ejector means for removing said tip from said lower end of said cylinder, means for coupling said cylinder assembly to said lower portion of said body member.

15. A pipette as claimed in claim 1, said cylinder assembly further comprising a cylinder with a lower end for receiving a reservoir tip for liquid, ejector means for removing said tip from said lower end of said cylinder, means for coupling said cylinder assembly to said lower portion of said body member.

* * * * *

UNITED STATES PATENT AND TRADEMARK OFFICE

CERTIFICATE OF CORRECTION

PATENT NO. : 4,988,481

DATED : January 29, 1991

INVENTOR(S) : Kari Jarvimaki et al

It is certified that error appears in the above-identified patent and that said Letters Patent is hereby corrected as shown below:

Claim 1, line bridging columns 4 and 5, the following should be deleted:

"said button having a skirt at the lower end thereof"

and insert after "first limiter" the following:

--in said upper portion of said body member--.

Signed and Sealed this

Thirtieth Day of June, 1992

*Attest:*

DOUGLAS B. COMER

*Attesting Officer*

*Acting Commissioner of Patents and Trademarks*